United States Patent [19]

Loeliger

[11] 4,153,182

[45] May 8, 1979

[54] PRESSURIZED DISPENSING CONTAINER WITH LINER

[75] Inventor: Arnold E. Loeliger, Pratteln, Switzerland

[73] Assignee: Aerosol Service, A.G., Basel, Switzerland

[21] Appl. No.: 693,701

[22] Filed: Jun. 7, 1976

[30] Foreign Application Priority Data

Jul. 2, 1975 [CH] Switzerland ..... 8649/75

[51] Int. Cl.[2] ..... B65D 25/14; B65D 83/14

[52] U.S. Cl. ..... 222/95; 29/451

[58] Field of Search ..... 222/95, 214, 183, 94, 222/386.5; 29/451, 453

[56] References Cited

U.S. PATENT DOCUMENTS

| | | | |
|---|---|---|---|
| 2,816,691 | 12/1957 | Ward | 222/183 |
| 3,317,090 | 5/1967 | Meshberg | 222/386.5 |
| 3,423,818 | 1/1969 | Ruekberg | 222/95 X |
| 3,595,440 | 7/1971 | Prussin et al. | 222/95 |
| 3,606,089 | 9/1971 | Chambers | 222/95 |
| 3,698,595 | 10/1972 | Gortz | 222/95 X |
| 3,896,970 | 7/1975 | Laauwe | 222/94 |

FOREIGN PATENT DOCUMENTS

| | | | |
|---|---|---|---|
| 2337235 | 7/1973 | Fed. Rep. of Germany | 222/95 |
| 1528108 | 4/1968 | France. | |
| 2236363 | 1/1975 | France | 222/95 |

*Primary Examiner*—Robert J. Spar
*Assistant Examiner*—Frederick R. Handren
*Attorney, Agent, or Firm*—James V. Tura

[57] ABSTRACT

A can for housing and dispensing liquid or pasty masses under pressure, comprising a substantially dimensionally stable, pressure-tight outer container having an opening edge upon which there is sealingly secured a valve plate equipped with a dispensing valve. An at least partially deformable inner container includes a neck portion whose opening edge is sealingly secured at the valve plate or at the part of the dispensing valve protruding into the interior of the can. The neck portion of the inner container is dimensionally stable, but elastically deformable in radial direction and equipped beneath its opening edge with peripheral cams protruding radially from the neck portion and dimensioned such that the inner container, during introduction into the outer container, sealingly bears initially by means of these cams upon the opening edge of the outer container and only after overcoming a resistance dependent upon the shape of the cams and the elasticity of the neck portion is further insertable into the outer container.

14 Claims, 4 Drawing Figures

FIG.1
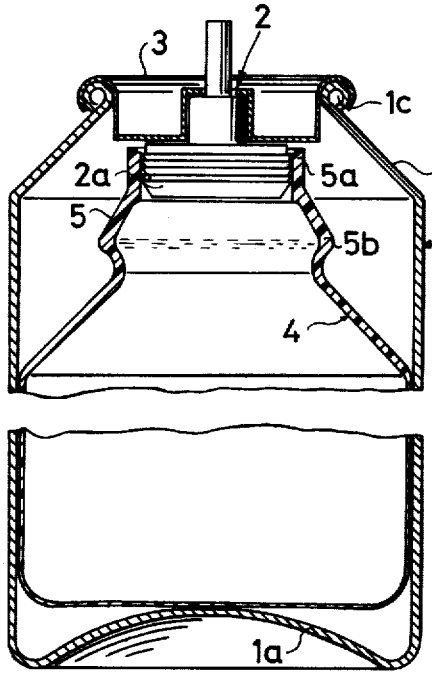
FIG. 2
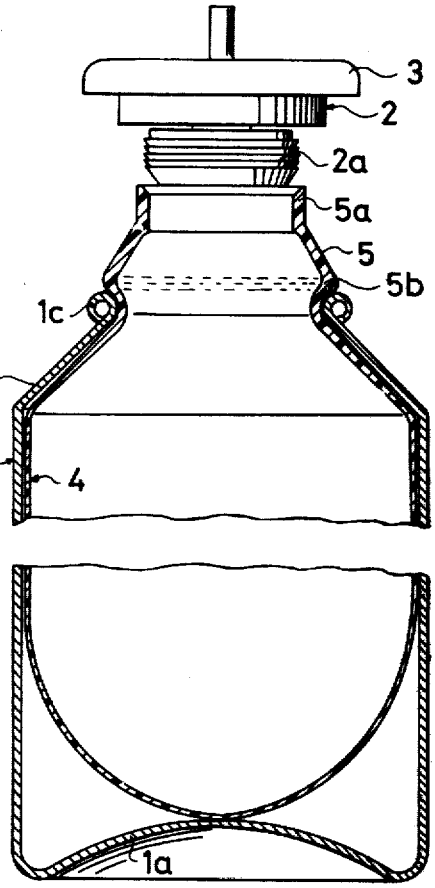
FIG. 3
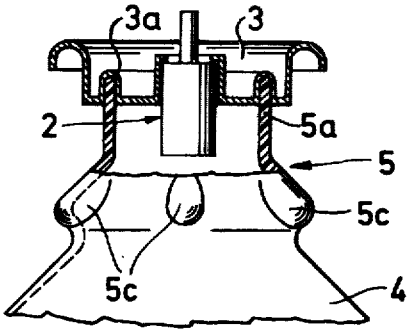
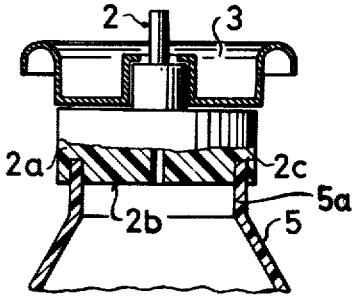
FIG. 4

PRESSURIZED DISPENSING CONTAINER WITH LINER

BACKGROUND OF THE INVENTION

The present invention relates to a new and improved construction of a can for housing and dispensing liquid or pasty masses under pressure.

Among the numerous cans for liquid or pasty materials, generally referred to as "aerosol cans", in more recent times one particular type of such can has found wide acceptance. Such type can comprises a flexible, compressible, sack-like or bag-like inner container which has its opening edge fixedly held at the opening edge of an outer container by means of a flanged portion of a valve plate carrying a dispensing valve, and additionally, at the floor of the outer container there is provided a propellent-infeed opening which is closed by a stopper. Upon opening the valve the inner container is compressed under the action of the pressure of the propellent and the therein contained material escapes through the valve.

These known aerosol cans are associated with a number of drawbacks, particularly as concerns the fabrication thereof. Thus, for example, in order to obtain an adequate seal and safety of the can which is under pressure it is necessary to employ extreme care during the closing of the propellent filling opening at the floor of the can. Further, the attachment of the valve plate carrying the valve with the edge of the outer container, and above all, the realization of an adequate seal is appreciably more difficult than in the case of cans without an inner container, since the clamped edge of the latter results in there being available appreciably less sealng surface and hence the closing operation must occur with greater precision. A drawback of such aerosol cans resides in the fact that the opening of the outer container must be markedly constricted. Thus, for the present day standardized outer containers none of the standardized valve plates (together with the valves) which are generally intended for cans without inner bags can be employed. Nor can such cans be so employed with standardized valve plates. Therefore, special constructions for either the outer container or for the valve plate are required.

There are already known to the art aerosol cans, for instance from U.S. Pat. No. 2,816,691, which do not have the previously discussed drawbacks, yet are however associated with other defects. With such cans the bag-shaped inner container is not attached at the edge of the outer container, rather at a part of the valve protruding into the interior of the container. Additionally, there is no propellent-filling opening in the floor of the can, rather the propellent is filled, prior to attachment of the valve plate at the outer container edge, through its opening. One of the notable drawbacks of this state-of-the-art aerosol can resides in the need to fill its inner container prior to insertion into the outer container, if the dispensing valve is not also simultaneously designed as a filling valve, which in many instances is not possible or at least disadvantageous and in any event results in relatively long filling times. In order that the inner container in its filled condition can be introduced into the outer container its diameter must not exceed the opening edge of the outer container. With the present day can shapes this, however, results in relatively small inner containers having, in relation to the outer container, uneconomical, small take-up capacity for the material which is to be filled. Additionally, the filling of the inner container outside of the outer container is rather cumbersome.

SUMMARY OF THE INVENTION

Hence, it is a primary object of the present invention to provide an improved aerosol can which avoids the previously discussed drawbacks of the known state-of-the-art constructions, and can be fabricated especially easily and without difficulty and also can be easily assembled together and filled.

Now in order to implement this object and others which will become more readily apparent as the description proceeds the present invention contemplates the provision of a can for the reception or housing and dispensing of liquid or pasty masses under pressure, comprising a dimensionally stable, pressure-tight outer container having an opening edge upon which there can be sealingly secured a valve plate equipped with a dispensing valve. Within the outer container there is arranged an at least partially deformable inner container having a neck portion, the opening edge of which is sealingly attached at the valve plate or at a part of the dispensing valve protruding into the interior of the can. Important aspects of the invention contemplate that the neck portion of the inner container is dimensionally stable, however elastically deformable in radial direction and is provided below its opening edge with peripheral protruding means e.g. a bead or cams which protrude in radial direction from the neck portion and are dimensioned in such a manner that the inner container when inserted into the outer container initially is seated by means of such peripheral protruding means upon the opening edge of the outer container and only after overcoming a resistance dependent upon the shape of the peripheral protruding means and the elasticity of the neck portion can be further inserted into the outer container.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a vertical cross-sectional view through an aerosol can according to the invention;

FIG. 2 is a vertical sectional view through the same can, however with the inner container not yet completely inserted into the outer container; and FIGS. 3 and 4 respectively illustrate detail variants of the can of FIG. 1.

DETAILED DESCRIPTION OF THE INVENTION

Describing now the drawings, the can illustrated in FIG. 1 will be seen to comprise an aluminum outer container 1 having a shape as the same is generally used at the present time including a domed floor or bottom 1*a* and conical upper portion 1*b* which terminates in a flanged opening edge 1*c*. In conventional manner there is attached to such opening edge 1*c* a valve unit comprising a valve plate 3 supporting a dispensing valve 2. The outer container 1, valve 2 and valve plate 3 are of conventional design.

Arranged internally of the outer container 1 is a compressible, sack-shaped or bag-shaped plastic inner container 4. Such possesses a relatively thick wall and to a certain degree a dimensionally stable neck portion 5, the opening edge 5a of which sealingly engages about or fixedly holds respectively, a substantially plug-shaped connection element 2a of the valve 2. In order to increase the adherence effect the connection element 2a has a sawtooth-like ribbed surface. The connection element 2a is either suitably connected with the valve housing of conventional valves protruding into the can interior or itself is constructed as the valve housing. Its diameter, which corresponds to the opening diameter of the inner container 4, should be as large as possible in order to facilitate and accelerate the filling operation of the inner container.

At the region of the neck portion 5, and specifically somewhat below the opening edge 5a, the inner container 4 is provided with a peripheral bead 5b or the wall of the neck portion is formed into such bead respectively. The diameter of this bead 5b is somewhat greater than that of the outer container-opening edge or mouth 1c, so that the inner container 4, during insertion into the outer container 1, initially seats by means of this bead 5b upon the container edge 1c and its complete insertion is thusly hindered, as the same has been shown in FIG. 2. Only when the opening edge or mouth 5a of the neck portion 5 is loaded in axial direction with a certain minimum force is the peripheral bead 5b resiliently inwardly moved in radial direction and thereby enables the further inward movement of the inner container 4. Instead of the bead 5b the neck portion 5 also could be provided with cams 5c (FIG. 3) protruding radially outwards and distributed over its periphery. What is only of importance is that the inner container 4 prior to its complete insertion into the outer container 1 is seated with its neck portion 5 upon the opening edge 1c of the outer container 1.

The advantages of the inventive can will be directly apparent from the following description of its assembly. To that end there is initially inserted the bag-shaped inner container 4 under deformation to such an extent into the outer container 1 until its peripheral bead 5b seats upon the opening edge or mouth 1c of the outer container 1. Now the inner container 4 is filled with the material to be received therein—a liquid or pasty mass—and this can occur very rapidly and in a time-saving manner due to the relatively large opening cross-section of the neck portion. Thereafter the connection element 2a of the valve 2 is pressed into the opening edge or mouth 5a of the inner container 5, resulting in a tight connection. As a result the neck portion 5 bears by means of its peripheral bead 5b at the opening edge or mouth 1c of the outer container 1. It should be understood that in this regard the elasticity and shape of the peripheral bead as well as the dimensional stability of the neck portion must be matched to one another in such a manner that the neck portion, during the insertion of the connection element under the action of the pressure force needed for this purpose, is not compressed together or upset and the bead does not resiliently bias radially inwardly i.e. does not release the inner container. After completion of the attachment of the valve 2 with the valve plate 3 the inner container 4 is now completely introduced into the outer container 1 by loading its neck portion 5a with a force sufficient to overcome the resistance exerted by the peripheral bead 5b, and the valve plate 3 initially loosely bears upon the mouth or opening edge 1c of the outer container 1. Now the propellent is filled in conventional manner into the intermediate space between the inner container 4 and the outer container 1 and finally the valve plate is sealingly secured in equally conventional manner at the opening edge of the outer container 1.

In FIGS. 3 and 4 there are illustrated two further attachment possibilities for the edge 5a of the inner container 4. According to FIG. 3 the edge is fixedly clamped in an annular or ring-shaped groove 3a formed at the valve plate 3. With the variant of FIG. 4 the valve housing serving as the connection element 2a is provided at its lower end face 2b with an annular or ring-shaped groove 2c in which there is fixedly held the opening edge 5a of the inner container 4 in suitable manner, for instance pressing-in such opening edge or the like. Of course, there are still conceivable and contemplated within the scope of the invention further attachment possibilities.

While there are shown and described preferred embodiments of the invention, it is to be distinctly understood that the invention is not limited thereto, but may be otherwise variously embodied and practiced within the scope of the following claims.

Accordingly, what is claimed is:

1. A can for dispensing a product comprising a substantially dimensionally stable pressure-tight outer container including a container body having an upper annular shoulder terminating in an edge defining an opening of a first diameter, a valve plate sealingly secured at said edge, a dispensing valve carried by said valve plate, an at least partially deformable inner container arranged within said outer container, said inner container including a container body having an upper annular shoulder terminating at a neck which in turn includes an opening in fluid communication with said valve, said neck being substantially dimensionally stable however elastically deformable in a radial direction, said neck including a portion disposed between said inner container upper annular shoulder and said inner container opening and protruding radially beyond said neck, said protruding portion having a maximum external diametrical dimension in its undeformed condition which is greater than said first diameter whereby said protruding neck portion can temporarily rest exteriorly upon said edge while filling the inner container and will radially inwardly elastically deform under the influence of an axial force to temporarily lessen said maximum diametrical dimension thus permitting said protruding neck portion to pass through said outer container opening, and said protruding neck portion being positioned totally below said outer container edge and in non-contacting relationship thereto.

2. The dispensing can as defined in claim 1 wherein said dispensing valve includes an annular groove, and a portion of said neck adjacent said neck opening is seated in said annular groove.

3. The dispensing can as defined in claim 1 wherein said protruding portion is a peripheral bead.

4. The dispensing can as defined in claim 1 wherein at least a single peripheral rib means is provided for interlockingly engaging said valve and a portion of said neck adjacent said neck opening.

5. The dispensing can as defined in claim 1 wherein said protruding portion has a wall thickness greater than the wall thickness of said container body below said inner container annular shoulder.

6. The dispensing can as defined in claim 1 including an outwardly opening peripheral groove disposed between said protruding portion and said inner container annular shoulder.

7. The dispensing can as defined in claim 1 wherein at least a single peripheral rib means is provided for interlockingly engaging said valve and a portion of said neck adjacent said neck opening, and said rib means is carried by said dispensing valve.

8. The dispensing can as defined in claim 1 wherein said protruding portion is defined by a plurality of cams peripherally spaced about said neck.

9. The dispensing can as defined in claim 2 wherein said protruding portion is a peripheral bead.

10. The dispensing can as defined in claim 2 wherein at least a single peripheral rib means is provided for interlockingly engaging said valve and a portion of said neck adjacent said neck opening.

11. The dispensing can as defined in claim 2 wherein said protruding portion has a wall thickness greater than the wall thickness of said container body below said inner container annular shoulder.

12. The dispensing can as defined in claim 9 wherein at least a single peripheral rib means is provided for interlockingly engaging said valve and a portion of said neck adjacent said neck opening.

13. The dispensing can as defined in claim 9 wherein said protruding portion has a wall thickness greater than the wall thickness of said container body below said annular shoulder.

14. The dispensing can as defined in claim 13 wherein at least a single peripheral rib means is provided for interlockingly engaging said valve and a portion of said neck adjacent said neck opening.

* * * * *